US005092530A

United States Patent [19]

Noirot et al.

[11] Patent Number: 5,092,530

[45] Date of Patent: Mar. 3, 1992

[54] COIL WINDING INSTALLATION AND METHOD FOR AUTOMATIC WIRE CHANGEOVER

[75] Inventors: Jacques Noirot, Annemasse; Michel Cham, St-Julien en Genevois; Guy Grellet, Rueil-Malmaison, all of France

[73] Assignee: Prosys S.A., Fillinges, France

[21] Appl. No.: 475,105

[22] Filed: Feb. 5, 1990

[30] Foreign Application Priority Data

Feb. 2, 1989 [FR] France ..... 8901650

[51] Int. Cl.[5] ..... H01F 41/06

[52] U.S. Cl. ..... 242/7.09; 242/7.18

[58] Field of Search ..... 242/7.01, 7.02, 7.03, 242/7.12, 7.09, 7.18

[56] References Cited

U.S. PATENT DOCUMENTS 3,713,599 1/1973 Smith et al. ..... 242/7.02 X 4,650,131 3/1987 Droll et al. ..... 242/7.09 X 4,809,917 3/1989 Tsuchiya ..... 242/7.18 X

*Primary Examiner*—Katherine Matecki

*Attorney, Agent, or Firm*—Collard, Roe & Galgano

[57] ABSTRACT

A coil winding installation includes a conventional winding machine with an XYZ table and supply tables moveable along a rail with respect to the winding machine. Each table carries a different type of wire delivered by a feeder and a supply coil with a wire guide bar and a fastening bar mounted on the supply table. The wire guide bars and fastening bars are moveable vertically on the supply table and for winding operations the wire guide bar is coupled and fixed to the XYZ table of the winding machine. Once the winding is completed, the wire guide bar is placed on the supply table which can be released to make room for another supply table equipped with a new type of wire. The wire changeover to go from one production series to another is thus automated and avoids the usual losses of time.

4 Claims, 4 Drawing Sheets

COIL WINDING INSTALLATION AND METHOD FOR AUTOMATIC WIRE CHANGEOVER

BACKGROUND OF THE INVENTION

This invention concerns the mass production of coils, particularly for electrical applications. More particularly, it relates to a coil winding installation and a method for automatically changing the wire in such an installation.

The winding operation consists of winding, over a core or nucleus, a wire usually made of enameled copper and coming from a mother coil known as a "feeder" with intermediate passage in a wire tension regulator known as a "supply coil". Winding is done over a revolving spindle which carries the core and is equipped with appropriate tooling.

The mass production of coils usually takes place on multi-spindle machines, generally with six, eight, twelve, eighteen or even more spindles, these spindles working in parallel, which implies the presence of as many feeders and supply coils working also in parallel as there are spindles. The feeders and supply coils are generally carried by a common structure known as a "supply table".

In this kind of industrial operation, the current criteria for production and profitability, for example short runs, "just in time" production, flexible shop, etc., call for very frequent changes in the type of coil to be produced.

The necessary changeover operations are very time consuming. This essentially concerns the change in the type of wire, on the supply table, for a rapid change of the tools on the spindles has already been relatively well worked out. Thus, the change of wire is done purely manually at this time and, for example, for a twelve spindle coil winding unit, it may require more than a half-hour during which time production is suspended. Furthermore, this task is particularly cumbersome and unprofitable.

SUMMARY OF THE INVENTION

Accordingly, it is an object of the present invention to provide a coil winding installation which affords automatic and quick wire changeover and which overcomes the aforesaid limitations and drawbacks of the aforementioned prior art.

It is a further object of the present invention to provide such a coil winding facility which allows the preparation of another type of wire to be done during "dead time", i.e., in advance of the wire changeover, so that the facility can continue to run with minimal interruption.

It is yet another object of the present invention to provide a method for changing the wire in such a facility.

These and other related objects are attained by the provision of a coil winding installation including a winding machine provided with at least one revolving spindle and one moveable XYZ table, and at least two supply tables providing respectively for each spindle the supply of wire of different types from respective feeders and supply coils. Each supply table carries a vertically controllable wire guide bar and a wire fastening bar. Means serve to couple the wire guide bar of the XYZ table in the working position for the fastening of the wire, its winding and cutting, the fastening bar then remaining controllable individually, and to uncouple the wire guide bar of the XYZ table after the winding is completed in order, if need be, to release and disengage the supply table from the winding machine and substitute for it another table provided with another type of wire. Preferably, each supply table is mobile and controllable in position with respect to the winding machine along a rail. Most desirably, movement of the supply tables take place under the action of a controlled motor.

Certain of the foregoing and related objects are also attained in a method for automatically changing the wire in a winding installation at the aforementioned inventive type which is characterized in that it consists of the steps of, after stopping the winding and fastening of the end of wire to a fastening lug of the winding machine, moving the fastening bar to its lower position, and moving the XYZ table to attach the wire to the fastening clamps of the fastening bar, the wire is then cut by means of the wire cutter of the winding machine, and the XYZ table is moved to place, by uncoupling, the wire guide bar on the supply table, disengaging. The XYZ table is then disengaged to release it from the wire guide bar and the wire guide bar and the fastening bar are returned to the upper position in the supply table. Thereafter, the supply table is disengaged from the field of the winding machine and a new supply table equipped with the new wire is brought into the field of the winding machine. The wire guide bar and the fastening bar are brought to the lower position, the XYZ table is moved to take up the wire guide bar and couple with it, and the XYZ table bearing the wire guide bar is moved to attach the wire to the fastening lug of the winding machine. Finally, the wire is unhooked from the fastening bar, and the fastening bar is returned to its upper release position.

BRIEF DESCRIPTION OF THE DRAWINGS

Other objects and features of the present invention will become apparent from the detailed description considered in connection with the accompanying drawings, which disclose several embodiments of the invention. It is to be understood that the drawings are to be used for the purpose of illustration only and not as definition of the limits of the invention.

In the drawings, wherein similar reference characters denote similar elements throughout the several views.

DETAILED DESCRIPTION OF THE PREFERRED EMBODIMENT

Referring now in detail to the drawings, in the following, barring exception, reference is made to a coil winding operation for a single coil, considered individually, it being understood that the same situations and phenomena occur simultaneously and in parallel for the production of other coils in keeping with the capacity of the multiple spindle installation.

Figure 1:
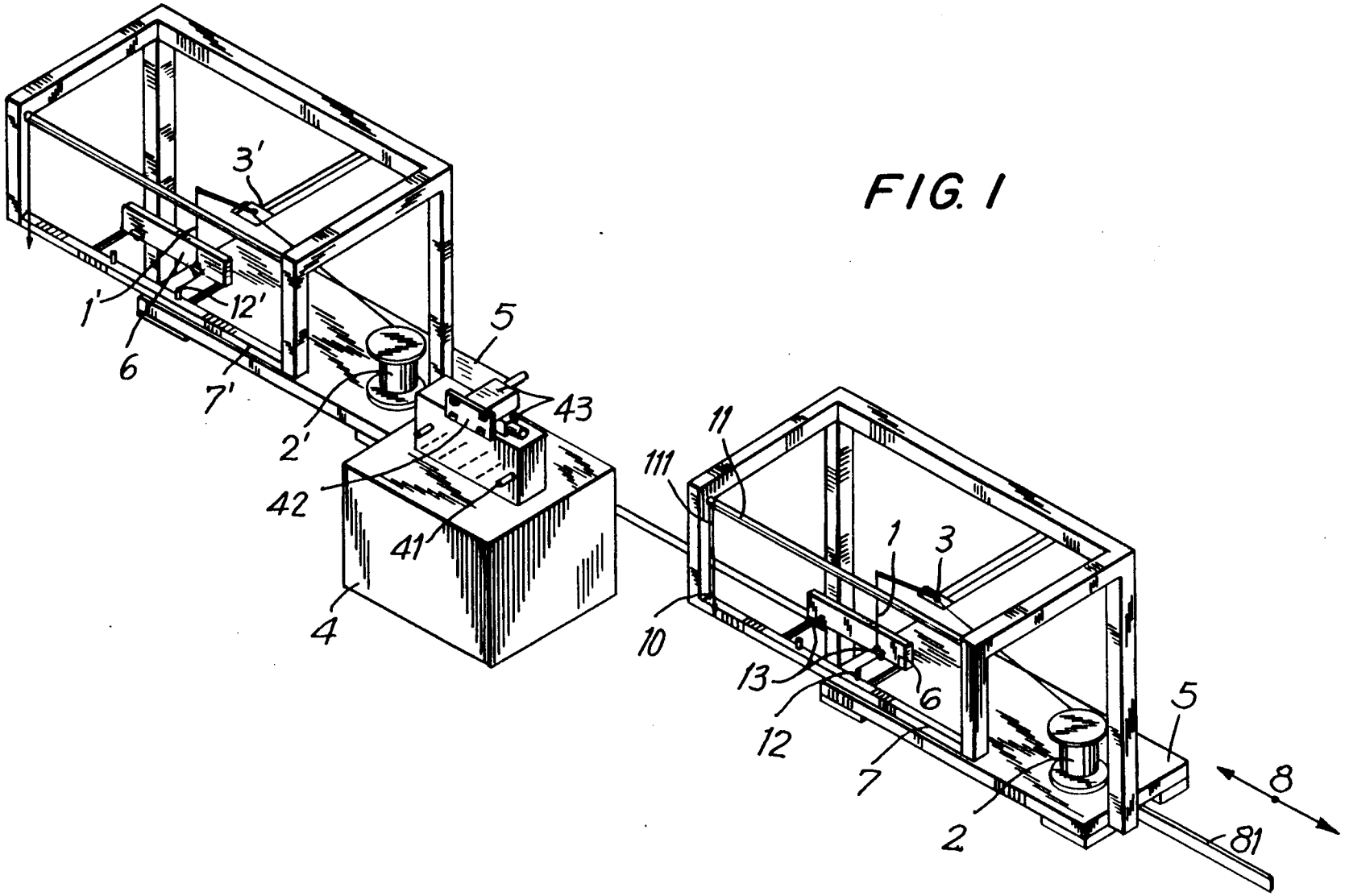
FIG. 1 is an overall schematic view of a facility according to the invention.
Figure 2A:
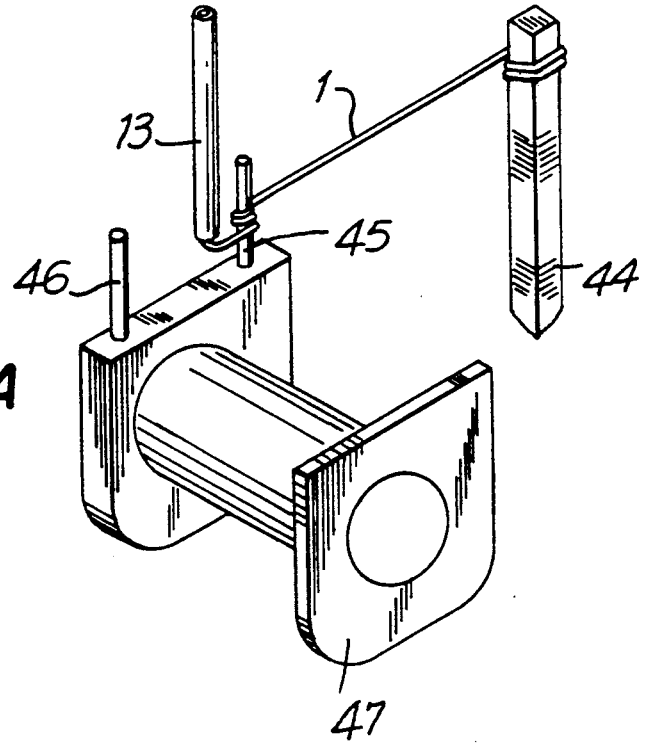
FIGS. 2A and 2B illustrate the traditional process for producing a coil.
Figure 2B:
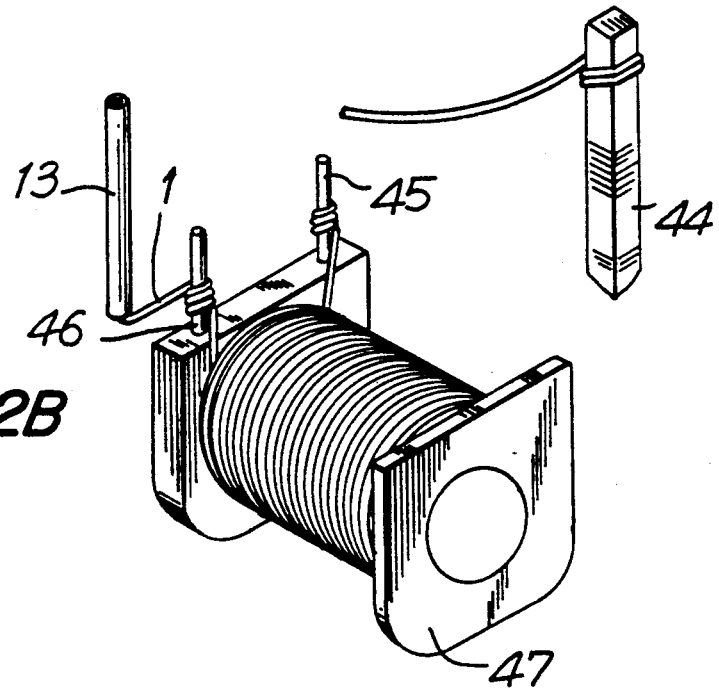

FIG. 1 shows a schematically a coil winding installation embodying the invention which includes a conventional fixed or stationary winding machine 4 which in and of itself, is not a part of the invention. As is known it carries, among other things, the spindles 41, an XYZ table 42, i.e., one which can be moved in three directions X, Y, Z, by means of motors 43. According to the technique illustrated in FIGS. 2A and 2B, for a single coil assumed to be mounted on its respective spindle (not shown), the wire 1 from a supply table coming out of a guide tube 13, carried by the winding machine, is first attached to a fastening lug 44 also carried by the winding machine, then the wire 1 is attached to the first terminal 45 of the coil 47. The actual winding then takes place, after separation of the fastening lug 44, until at the end of this phase, the wire 1 is attached to the second terminal 46 of the coil 47 to complete the operation. Wire 1 is then again attached to the lug 44 which has been cleaned in the meantime, and cut. The cycle is then repeated for a new coil 47. These operations, the result of the work performed by the spindle and the XYZ table 42, are well known to one skilled in the art and require no further discussion.

According to the invention, each type of wire 1 is assigned to a distinct supply table 5, 5', these tables 5, 5' being reciprocally movable (represented by the double arrow 8) along a rail 81 preferably by motorization (not shown). As a result, each table 5, 5' can be brought into the field of the winding machine 4 and disengaged from same in order to make room for another table.

Each supply table 5, as illustrated in FIG. 1, carries a supply coil 2 corresponding to each spindle 41 of the winding machine 4 and to a feeder 3 regulating the tension of the wire 1 which it dispenses, as is known to those skilled in the art. It is further equipped with a wire guide bar 6 and a wire fastening bar 7.

It should be noted that the wire guide bar 6, according to the known technique, forms a part of the winding machine 4 while, according to the invention, it is mounted on the supply table 5.

The wire guide bar 6 carries wire guides 13 corresponding to each spindle 41, feeder 3 and supply coil 2, respectively. These wire guides, as in the technique referred above in reference to FIGS. 2A and 2B, serve to guide the wire 1 during the fastening, attachment and winding operation on the winding machine 4.

The fastening bar 7 has fastening clamps 12 serving to maintain the end of the wires 1 downstream of the wire guides 13 when the supply table 5 is at rest.

The wire guide bars 6 and fastening bars 7 of the supply table 5 can be moved vertically, as indicated by arrow 10, by means of a motor-driven rotatable shaft 11 with a cable transmission 111 on the fastening bar 7.

For the winding operation, the supply table 5, is positioned along the rail 81 at the work station represented by the winding machine 4. An automatic device carried by the winding machine 4 serves to fix the wire guide bar 6 of the supply table to the XYZ table 42 of the winding machine 4 for the winding operations and to release this bar 6 to return it to the supply table 5 when the winding machine 4 is at rest.

The operation of the installation according to the invention is illustrated schematically by the sequence of FIGS. 3A to 3L which are transverse views through the winding machine 4 in a plane perpendicular to the rail 81. The sketches show the winding machine 4 with its XYZ table 42 connected to motor 43, a shaft for the spindle 41 (dotted line) and a fastening lug 44 of the winding machine 4.

Figure 3A:
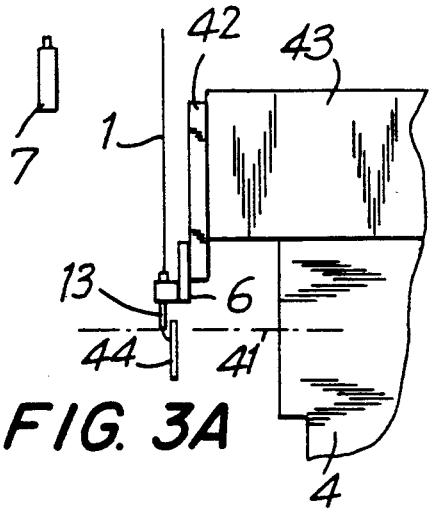
FIGS. 3A to 3L represent schematically the successive phases of the process for changing the wire automatically, in accordance with the invention.

In FIG. 3A, the operation of the winding machine 4 is stopped just at the end of production of a series of coils (not shown). The fastening bar 7 of the supply table 5 (not shown) has returned to its upper release position (up arrow 10 of FIG. 1). The wire guide bar 6 bearing the wire guide 13 is moved to a fixed and coupled position with respect to XYZ table 42. The wire 1 is attached to the fastening lug 44 of the winding machine 4. In order to start the production of a new series of coils, it is necessary to change the wire 1.

Figure 3B:
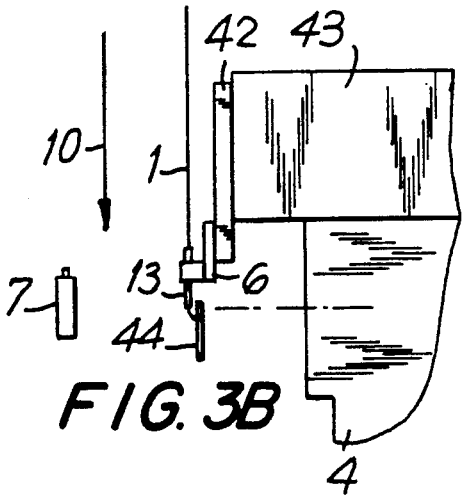

In FIG. 3B, fastening bar 7 is brought to its lower position (down arrow 10), i.e., its working position.

Figure 3C:
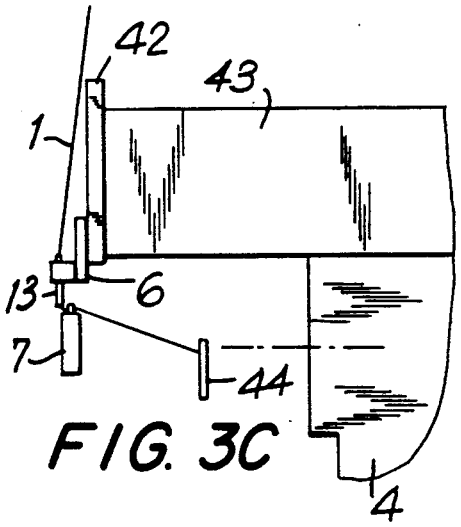

In FIG. 3C, the XYZ table 42, and therefore the wire guide bar 6 which is fixed with it, is brought by transversal and vertical ascending movement to the fastening position for the wire 1 and the wire is attached to the fastening clamp 12 of the fastening bar 7.

Figure 3D:
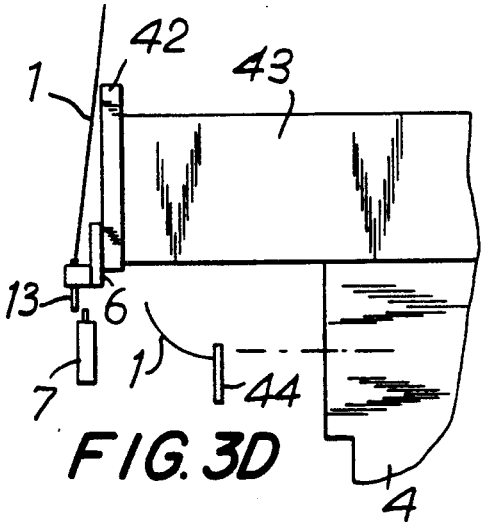

When this fastening operation is completed, the wire 1 is cut by the conventional wire cutter of the winding machine 4 as illustrated in FIG. 3D, and the fastening lug 44 continues to carry the separated section of the wire 1.

Figure 3E:
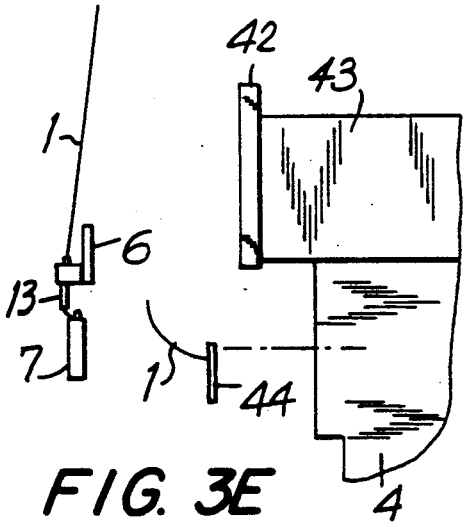

The wire guide bar 6, by movement of XYZ table 42, is then placed on the supply table 5, i.e., in the position represented in the left hand portion of FIG. 3E. The XYZ table 42, released from the wire guide bar 6, is then brought back to arrive in the position illustrated in the right hand portion of FIG. 3E.

Figure 3F:
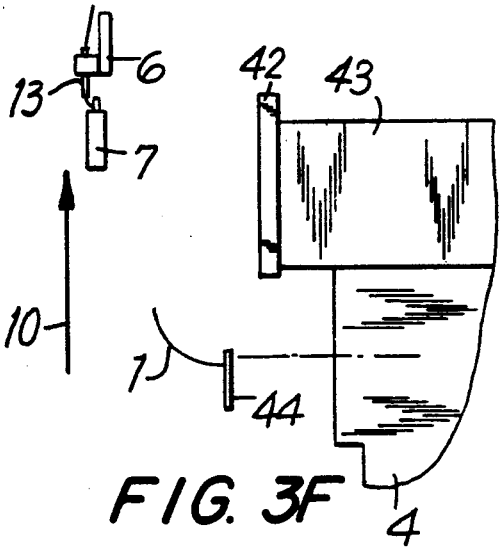

Then, as in FIG. 3F, the wire guide bars 6 and the fastening bars 7, now carried by the supply table 5, are brought to the upper position (up arrow 10), which removes them completely from the space corresponding to the winding station. At this point, there is no further connection between the winding machine 4 and the supply table 5.

Figure 3G:
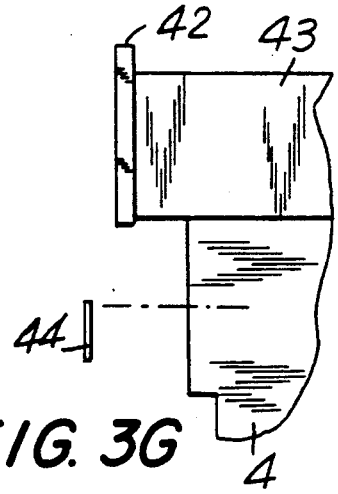

The supply table 5, by movement along the rail 81, has then left the field of the winding machine 4 and the situation is now as illustrated in FIG. 1 (right hand side). The fastening lug 44 is freed of the remaining wire 1 and, as shown in FIG. 3G, the winding machine 4 is ready to receive the new wire 1' for the production of a new series of coils.

A new supply table 5' carrying the new type of wire 1' represented in the left hand portion of FIG. 1 and, as it were, perfectly identical to the first table 45, is ready to be moved along the rail 81 to come in position and engage with the winding machine 4. The references relative to this second supply table 5' are the same as for the first table 5, but include the index ' (prime).

Figure 3H:
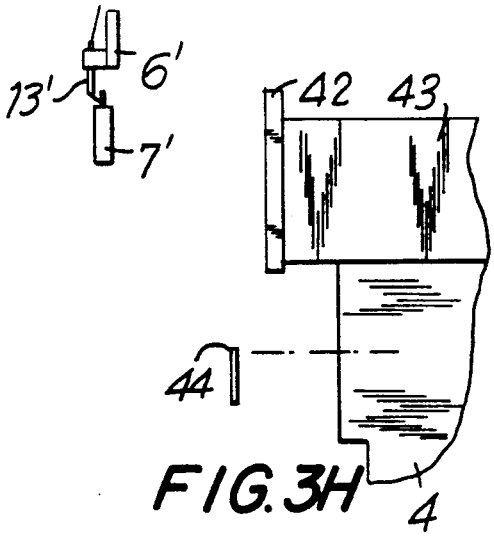

The situation is as illustrated in FIG. 3H, as soon as the supply table 5' has been brought to the winding position.

Figure 3I:
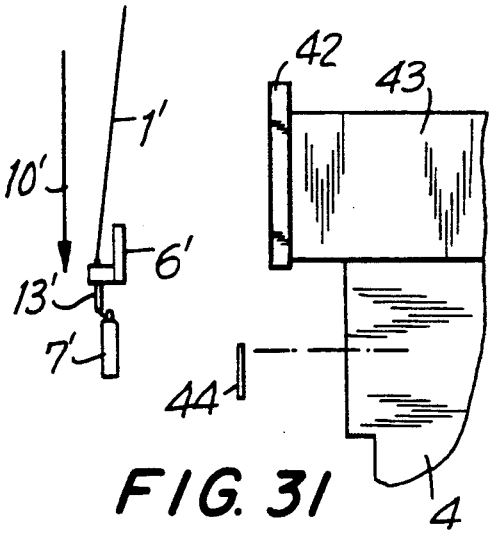
Figure 3J:
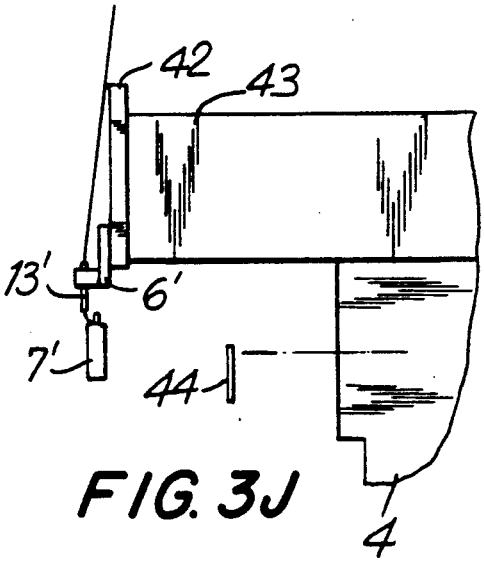

In the following phase, FIG. 3I, the unit consisting of the wire guide bar 6' and the fastening bar 7' is brought to the lower position according to the down arrow 10'. The XYZ table 42 is moved to take up the wire guide bar 6' and form an abutting relationship with it. The situation is then as illustrated in FIG. 3J.

Figure 3K:
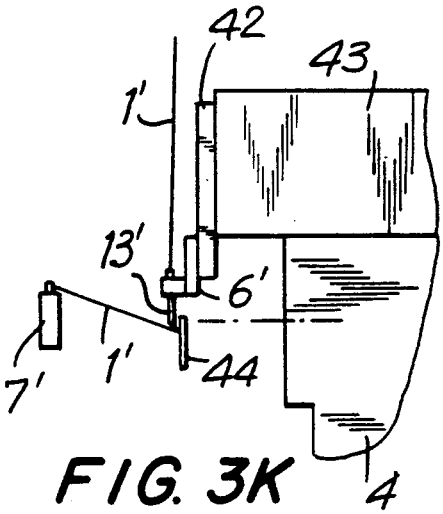
Figure 3L:
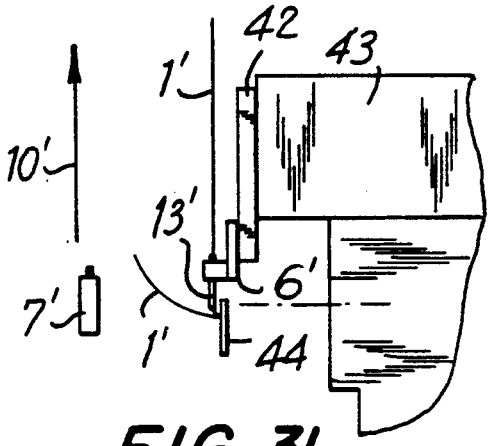

XYZ table 42 bearing the wire guide bar 6' is then moved in order to attach the wire 1' to the fastening lug 44 of the winding machine 4, as shown in FIG. 3K. When this fastening is completed, the end of the wire 1' is unhooked by the ejector of the fastening bar 7', in a manner of itself known and as illustrated in FIG. 3L. The fastening bar 7' thus released can then be raised (up arrow 10') and the situation is now one in which the winding work with the new wire 1' can begin, i.e., the situation of FIG. 3A which corresponds to that at the end of production, with the winding completed, but is otherwise the same.

In the foregoing, it is clear that the description refers only to those characteristics of the invention which go beyond the present state of the technology, perfectly well known to one skilled in the art. Thus, the known functions of moving the XYZ table 42, the functions of fastening, winding, cutting the wire, etc., have not been detailed. The same holds true for the means of motorization of the supply tables 4, 5' along the rail 81 (arrow 8) and of the wire guide bars 6, 6' and fastening bars 7, 7' (arrow 10) and the means of coupling-uncoupling the wire guide bar 6, 6' to and from the XYZ table 42.

It remains to be noted that the invention is totally foreign to problems of tool changing on the winding spindles 41. It concerns only the changing of wires; the tools utilized may eventually remain the same in spite of the change of wires.

For a twelve spindle winding machine, a conventional change of wire causes a shut-down of the machine of generally more than a half-hour. The automatic change according to the invention makes it possible to reduce this interruption to approximately 3 minutes. Therefore, there is practically no more loss of production time for wire changing.

Thus, while only one embodiment of the invention has been shown and described, it is obvious that many changes and modifications may be made thereunto without departing from the spirit and scope of the invention.

What is claimed is:

1. A coil winding installation comprising:

a winding machine including at least one rotatable spindle and at least one XYZ table movable and translatable in the X,Y and Z directions;

a plurality of supply tables for said spindle each of which carries a feeder and supply coil for supplying wire of different types, each of said supply tables including a vertically controllable and movable wire guide bar, an independently controllable and vertically movable wire fastening bar, and a motor operatively connected to said guide bar and said fastening bar for controlling the vertical movement thereof; and means for coupling and uncoupling said wire guide bar to said XYZ table for effecting movement thereof between a working position in which said bar is coupled to said XYZ table to permit said wire to be fastened, wound and cut, and a release position, in which said wire guide bar may be uncoupled from said XYZ table after the winding is completed to permit release and disengagement of said supply table from said winding machine and allow substitution of another of said supply tables provided with a different type of wire, so that said supply tables which are disengaged from said winding machine can be fitted with new supply coils, the wires of which can be fed through said wire guide feeder and attached to said wire fastening bar while one of said supply tables which is in a working position continues to feed wire to said winding machine.

2. The winding installation of claim 1, additionally including a rail and wherein said supply tables are mounted on said rail for controlled movement therealong.

3. The winding installation of claim 2, additionally including a motor for controlling movement of said supply tables along said rail.

4. A process for automatically changing the wire in a winding installation of the type including a winding machine including at least one rotatable spindle and at least one XYZ table movable and translatable in the X,Y and Z directions, a wire cutter and a fastening lug, a plurality of supply tables for said spindle each of which carries a feeder and supply coil for supplying wire of different types, each of said supply tables including a vertically controllable and movable wire guide bar and a wire fastening bar having fastening clamps moveable between an upper and lower position, and means for coupling and uncoupling said wire guide bar to said XYZ table for effecting movement thereof between a working position in which said bar is coupled to said XYZ table to permit said wire to be fastened, wound and cut, and a release position, in which said wire guide bar may be uncoupled from said XYZ table after the winding is completed to permit release and disengagement of the supply table from said winding machine and allow substitution of another of said supply tables provided with a different type of wire, comprising the steps of:

stopping the winding operation and fastening one end of wire to a fastening lug of the winding machine;

moving the fastening bar to its lower position;

moving said XYZ table to attach the wire to the fastening clamps of the fastening bar;

cutting said wire by means of the wire cutter of the winding machine;

moving said XYZ table to place, by uncoupling, the wire guide bar on the supply table;

disengaging the XYZ table thus released from the wire guide bar;

returning the wire guide bar and the fastening bar to the upper position in the supply table;

disengaging and removing the supply table from the winding machine;

bringing a new supply table equipped with the new wire into a working position with respect to the winding machine;

bringing the wire guide bar and the fastening bar to the lower position;

moving the XYZ table to take up the wire guide bar and couple with it;

moving the XYZ table bearing the wire guide bar to attach the wire to the fastening lug of the winding machine;

unhooking the wire from the fastening bar; and returning the fastening bar to its release upper position, so that said supply tables which are disengaged from said winding machine can be fitted with new supply coils, the wires of which can be fed through said wire guide feeder and attached to said wire fastening bar while one of said supply tables which is in a working position continues to feed wire to said winding machine.

* * * * *